US009018499B1

(12) United States Patent
Compani-Tabrizi

(10) Patent No.: US 9,018,499 B1
(45) Date of Patent: Apr. 28, 2015

(54) COMPANI BRACES FOR MUSICAL INSTRUMENTS

(71) Applicant: Behrooz Compani-Tabrizi, Laguna Hills, CA (US)

(72) Inventor: Behrooz Compani-Tabrizi, Laguna Hills, CA (US)

(73) Assignee: Behrooz Compani-Tabrizi, Laguna Hills, CA (US)

( * ) Notice: Subject to any disclaimer, the term of this patent is extended or adjusted under 35 U.S.C. 154(b) by 0 days.

(21) Appl. No.: 14/314,365

(22) Filed: Jun. 25, 2014

Related U.S. Application Data

(60) Provisional application No. 61/893,368, filed on Oct. 21, 2013.

(51) Int. Cl.
*G10D 3/00* (2006.01)

(52) U.S. Cl.
CPC ..... *G10D 3/00* (2013.01)

(58) Field of Classification Search
CPC ..... G10D 3/00
See application file for complete search history.

(56) References Cited

U.S. PATENT DOCUMENTS

| | | | | |
|---|---|---|---|---|
| 5,461,958 | A * | 10/1995 | Dresdner et al. | 84/267 |
| 6,664,452 | B1 * | 12/2003 | Teel | 84/291 |
| D592,697 | S * | 5/2009 | Park | D17/20 |
| 7,612,271 | B1 * | 11/2009 | Davis et al. | 84/267 |
| 8,648,237 | B1 * | 2/2014 | Schenk | 84/268 |

* cited by examiner

*Primary Examiner* — Robert W Horn

(57) ABSTRACT

The conventional musical instrument top and back plates are supported with straight and scalloped braces. These braces tend to dampen vibrations along the length direction of the brace. Kerfed braces are introduced to mitigate the damping. If glued with their kerfed edge to the top or back plates they mitigate damping without much compromise in their strengthening properties.

3 Claims, 2 Drawing Sheets

Incorrectly (top) and correctly (bottom) glued braces to the top plate

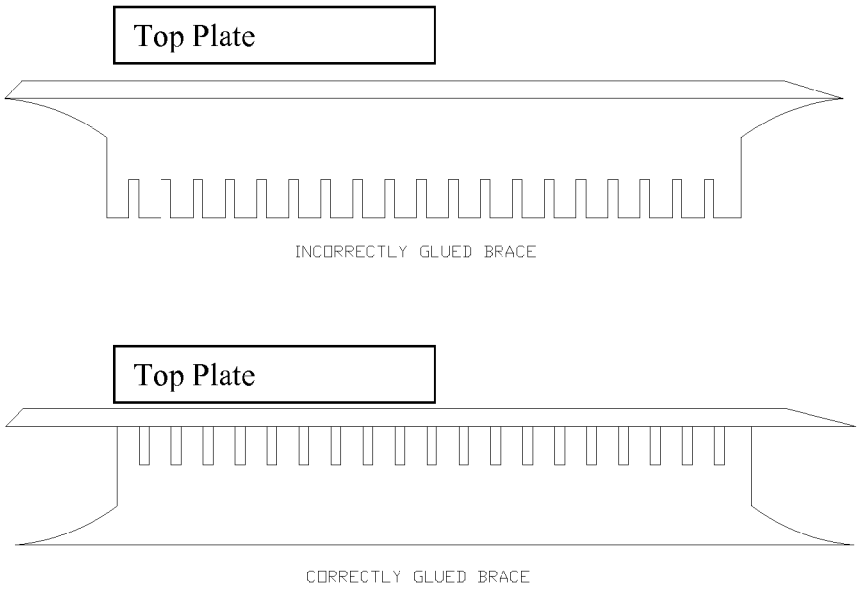
Figure 1. Incorrectly (top) and correctly (bottom) glued braces to the top plate

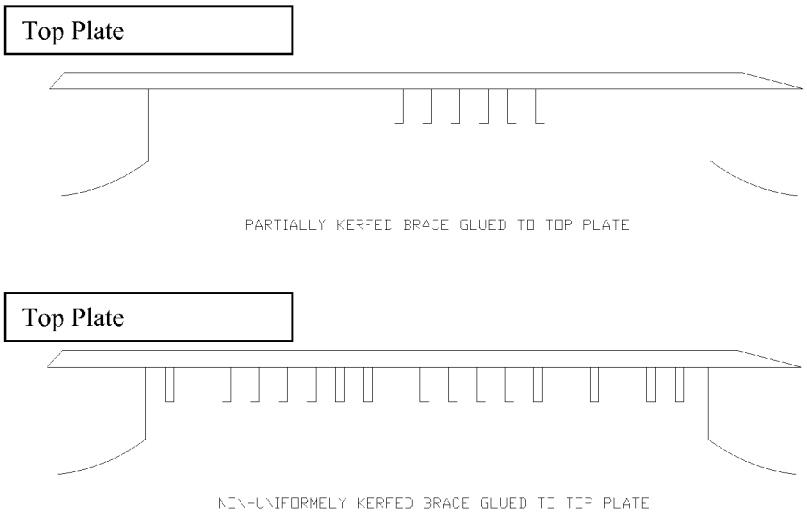
Figure 2. Partially kerfed (top) and non-uniformely kerfed braces glued to the top plate

COMPANI BRACES FOR MUSICAL INSTRUMENTS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention is related to the structure of braces used in musical instruments, such as, but not limited to guitars, violins, cellos, basses, mandolins, ouds and lutes.

2. Description of the Related Art

The braces in musical instruments are strips, usually made of wood, glued to the top and back plates of the instruments. Bracing types and bracing patterns have shown to be of great importance to instrument construction and define the instruments voicing and the luthier's identity. Presently there are two types of braces used by luthiers. These are the straight braces and the scalloped braces. Straight braces are long rectangular pieces of thinly cut wood that may be shaped "scalloped" only at the ends. Scalloped braces are scalloped not only at the ends but also along the length of the brace. Scalloped braces tend to be lighter and more flexible than the straight braces. These two types of braces are made of non-kerfed strips and, due to their relative rigidity, tend to eliminate or dampen the oscillations of the top (back) plate along the direction of the braces. This damping effect is more pronounced for the allowed higher frequencies oscillations of the top and back plates.

Braces are used singly or in-groups making a pattern, such as honeycomb, fan, or lattice bracing patterns. Bracing patterns and bracing types are both used to control the strength, volume, and voicing of the instrument. The proposed invention addresses a new bracing type, namely the kerfed brace, and does not concern itself with bracing patterns.

BRIEF SUMMARY OF THE PRESENT INVENTION

Kerfings have been used in the construction of musical instruments at the boundaries of tops and backs to glue and attach the top and back plates to the sides of instruments. They have not been used as braces to control the volume and the sound quality. The conventional braces tend to dampen the vibrations of the instrument. Kerfed braces are invented to mitigate this damping.

BRIEF DESCRIPTION OF THE DRAWINGS

FIG. 1 shows the side view of two identical kerfed straight braces both with 20 teeth and 19 kerfed slots. The top figure shows an incorrectly glued kerfed brace to the top plate of the instrument. In the top configuration the kerfed brace is equivalent to a non-kerfed brace of the same dimensions but without the teeth as the teeth do not contribute to the strengthening of the plates. The bottom figure shows a correctly installed kerfed brace that will strengthen the top, with strength contributions from the teeth, but has more flexibility (i.e., bending and vibrating ability) than its non-kerfed counterpart.

FIG. 2 shows the side view of two straight kerfed braces. The top drawing shows a partially kerfed brace and the bottom drawing shows a non-uniformly kerfed brace.

DETAILED DESCRIPTION OF THE INVENTION

Kerfed braces are more flexible than the conventional straight and scalloped (non-kerfed) braces of the same size and composition. They can be bent to a maximum curvature determined by the kerf width, the number of kerfed slots and the brace material. This flexibility enables a kerfed brace to vibrate in more vibration modes (i.e. more allowed frequencies) than its non-kerfed counterpart along its length direction. Kerfed braces produce a sound quality richer in frequency content than their conventional counterparts. The following quantitative analysis gives a formula that serves mostly as rules of thumb for frequencies of vibrations that are allowed by the kerfed brace.

The longest wavelength of vibrations of a brace with fixed end points is twice the length of the brace and corresponds to the principle frequency. Depending on the stiffness and density and other material properties of the brace, a finite number of other wavelengths (frequencies) may be excited. If the length of the brace is L these wavelengths ($\lambda n$) take the values given by $$L=(n/2)\cdot\lambda n$$

Where, n=1, 2, 3, . . . up to a practical maximum value N. For a traditional brace N is not a large number and practically the brace is limited to vibrate in none, or a few modes. Their equivalent more flexible kerfed braces allow for more modes of vibrations corresponding to a larger value of N. If the number of uniformly kerfed cuts along the length L is M, the kerf width is K, and the sum of the widths of the teeth is T then $$L-T=M\cdot K$$

The above two relations combine to give a good approximation for M given by $$\lambda n=2\cdot(L-M\cdot K)/n$$

This relation quantitatively shows the intuitive result that to produce the wavelength $\lambda n$ larger values of K will force smaller values of M and vise versa. The luthier should make a practical compromise on choosing a practical kerf width K and the corresponding M.

For kerfed braces with varying kerf spacing and braces with free end points similar relations can be found but are not presented in this writings.

Kerfed braces are not as strong as their counterparts. However, by gluing the kerfed brace on the kerfed edge to the plate will maximize the strengthening properties of the brace.

The invention claimed is:

1. Kerfed braces with uniform kerf spacing with their kerfed edge glued to the top (back) plate of musical instruments.

2. Kerfed braces with non-uniform kerf spacing patterns with their kerfed edge glued to the top (back) plate of musical instruments.

3. Kerfed braces with varying depth of kerf with their kerfed edge glued to the top (back) plate of musical instruments.

* * * * *